US007754305B2

(12) United States Patent
Yamamoto et al.

(10) Patent No.: US 7,754,305 B2
(45) Date of Patent: Jul. 13, 2010

(54) HIGH MN AUSTENITIC STAINLESS STEEL

(75) Inventors: Yukinori Yamamoto, Oak Ridge, TN (US); Michael L Santella, Knoxville, TN (US); Michael P Brady, Oak Ridge, TN (US); Philip J Maziasz, Oak Ridge, TN (US); Chain-tsuan Liu, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 12/181,718

(22) Filed: Jul. 29, 2008

(65) Prior Publication Data

US 2008/0292489 A1 Nov. 27, 2008

Related U.S. Application Data

(63) Continuation-in-part of application No. 11/619,944, filed on Jan. 4, 2007.

(51) Int. Cl.

| | |
|---|---|
| ***C22C 38/42*** | (2006.01) |
| ***C22C 38/30*** | (2006.01) |
| ***C22C 38/60*** | (2006.01) |
| ***C22C 38/58*** | (2006.01) |
| ***C22C 38/00*** | (2006.01) |

(52) U.S. Cl. ..... 428/49; 420/38; 420/40; 420/42; 420/45; 420/47; 420/48; 148/326; 148/327

(58) Field of Classification Search ..... None
See application file for complete search history.

(56) References Cited

U.S. PATENT DOCUMENTS 3,826,689 A 7/1974 Ohta et al.

(Continued)

FOREIGN PATENT DOCUMENTS

JP 09-324246 * 12/1997

(Continued)

OTHER PUBLICATIONS

Yamamoto, et al., "Alumina-Forming Austenitic Stainless Steels Strengthened by Laves Phase and MC Carbide Precipitates," Metallurgical and Materials Transactions A, 2007.

(Continued)

*Primary Examiner*—Melvin C Mayes
*Assistant Examiner*—Sarah Van Oudenaren
(74) *Attorney, Agent, or Firm*—Novak Druce + Quigg LLP; Gregory A. Nelson; Gregory M. Lefkowitz

(57) ABSTRACT

An austenitic stainless steel alloy includes, in weight percent: >4 to 15 Mn; 8 to 15 Ni; 14 to 16 Cr; 2.4 to 3 Al; 0.4 to 1 total of at least one of Nb and Ta; 0.05 to 0.2 C; 0.01 to 0.02 B; no more than 0.3 of combined Ti+V; up to 3 Mo; up to 3 Co; up to 1W; up to 3 Cu; up to 1 Si; up to 0.05 P; up to 1 total of at least one of Y, La, Ce, Hf, and Zr; less than 0.05 N; and base Fe, wherein the weight percent Fe is greater than the weight percent Ni, and wherein the alloy forms an external continuous scale including alumina, nanometer scale sized particles distributed throughout the microstructure, the particles including at least one of NbC and TaC, and a stable essentially single phase FCC austenitic matrix microstructure that is essentially delta-ferrite-free and essentially BCC-phase-free.

5 Claims, 3 Drawing Sheets

U.S. PATENT DOCUMENTS

| | | | |
|---|---|---|---|
| 3,839,022 | A | 10/1974 | Webster et al. |
| 3,865,644 | A | 2/1975 | Hellner et al. |
| 3,989,514 | A | 11/1976 | Fujioka et al. |
| 4,086,085 | A | 4/1978 | McGurty |
| 4,204,862 | A | 5/1980 | Kado et al. |
| 4,385,934 | A | 5/1983 | McGurty |
| 4,530,720 | A | 7/1985 | Moroishi et al. |
| 4,560,408 | A | 12/1985 | Wilhelmsson |
| 4,572,738 | A | 2/1986 | Korenko et al. |
| 4,576,653 | A | 3/1986 | Ray |
| 4,767,597 | A | 8/1988 | Nishino et al. |
| 4,818,485 | A | 4/1989 | Maziasz et al. |
| 4,822,695 | A | 4/1989 | Larson et al. |
| 4,849,169 | A | 7/1989 | Maziasz et al. |
| 5,130,085 | A | 7/1992 | Tendo et al. |
| 5,217,684 | A | 6/1993 | Igarashi et al. |
| 5,480,283 | A | 1/1996 | Doi et al. |
| 5,501,834 | A | 3/1996 | Nakasuji et al. |
| 5,603,891 | A | 2/1997 | Brill |
| 5,618,491 | A | 4/1997 | Kurup et al. |
| 5,945,067 | A | 8/1999 | Hibner et al. |
| 6,004,408 | A | 12/1999 | Montagnon |
| 6,193,145 | B1 | 2/2001 | Fournier et al. |
| 6,352,670 | B1 | 3/2002 | Rakowski |
| 6,372,181 | B1 | 4/2002 | Fahrmann et al. |
| 6,447,716 | B1 | 9/2002 | Cozar et al. |
| 6,866,816 | B2 | 3/2005 | Liang et al. |
| 2004/0060622 | A1 | 4/2004 | Lilley |
| 2004/0191109 | A1 | 9/2004 | Maziasz et al. |
| 2007/0086910 | A1 | 4/2007 | Liang |
| 2007/0217941 | A1 | 9/2007 | Hayashi et al. |

FOREIGN PATENT DOCUMENTS

| | | | |
|---|---|---|---|
| JP | 09324246 | * | 12/1997 |

OTHER PUBLICATIONS

Brady, et al., Effects of Minor Alloy Additions and Oxidation Temperature on Protective Alumina Scale Formation in Creep-Resistant Austenitic Stainless Steels, Scripta Materialia, 2007, pp. 1117-1120, vol. 57.

* cited by examiner

HIGH MN AUSTENITIC STAINLESS STEEL

CROSS-REFERENCE TO RELATED APPLICATIONS

This patent application is a continuation-in-part of U.S. patent application Ser. No. 11/619,944 filed on Jan. 4, 2007 by Michael P. Brady, et al. entitled "Oxidation Resistant High Creep Strength Austenitic Stainless Steel", the entire disclosure of which is incorporated herein by reference.

Specifically referenced is U.S. patent application Ser. No. 12/103,837 filed on Apr. 16, 2008 by Michael P. Brady, et al. entitled "High Nb, Ta, and Al Creep- and Oxidation-Resistant Austenitic Stainless Steels", the entire disclosure of which is incorporated herein by reference.

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

NAMES OF PARTIES TO A JOINT RESEARCH AGREEMENT

None

BACKGROUND OF THE INVENTION

One of the strongest drivers for the development of new industrial materials is to decrease cost compared to existing materials while maintaining or improving properties. An important example is high temperature structural alloys for power generation systems. Higher operating temperatures in power generation result in reduced emissions and increased efficiencies. Conventional austenitic stainless steels currently offer good creep strength and environmental resistance up to 600-700° C. However, in order to meet emission and efficiency goals of the next generation of power plants structural alloys will be needed to increase operating temperatures by 50-100° C. High nickel austenitic stainless steels and nickel-based superalloys can meet the required property targets, but their costs for construction of power plants are prohibitive due to the high cost of nickel.

BRIEF SUMMARY OF THE INVENTION

In accordance with one aspect of the present invention, the foregoing and other objects are achieved by an austenitic stainless steel alloy including, in weight percent: >4 to 15 Mn; 8 to 15 Ni; 14 to 16 Cr; 2.4 to 3 Al; 0.4 to 1 total of at least one of Nb and Ta; 0.05 to 0.2 C, 0.01 to 0.02 B; no more than 0.3 of combined Ti+V; up to 3 Mo; up to 3 Co; up to 1 W; up to 3 Cu; up to 1 Si; up to 0.05 P; up to 1 total of at least one of Y, La, Ce, Hf, and Zr; less than 0.05 N; and base Fe, wherein the weight percent Fe is greater than the weight percent Ni, and wherein the alloy forms an external continuous scale including alumina, nanometer scale sized particles distributed throughout the microstructure, the particles including at least one of NbC and TaC, and a stable essentially single phase FCC austenitic matrix microstructure that is essentially delta-ferrite-free and essentially BCC-phase-free.

Figure 1:
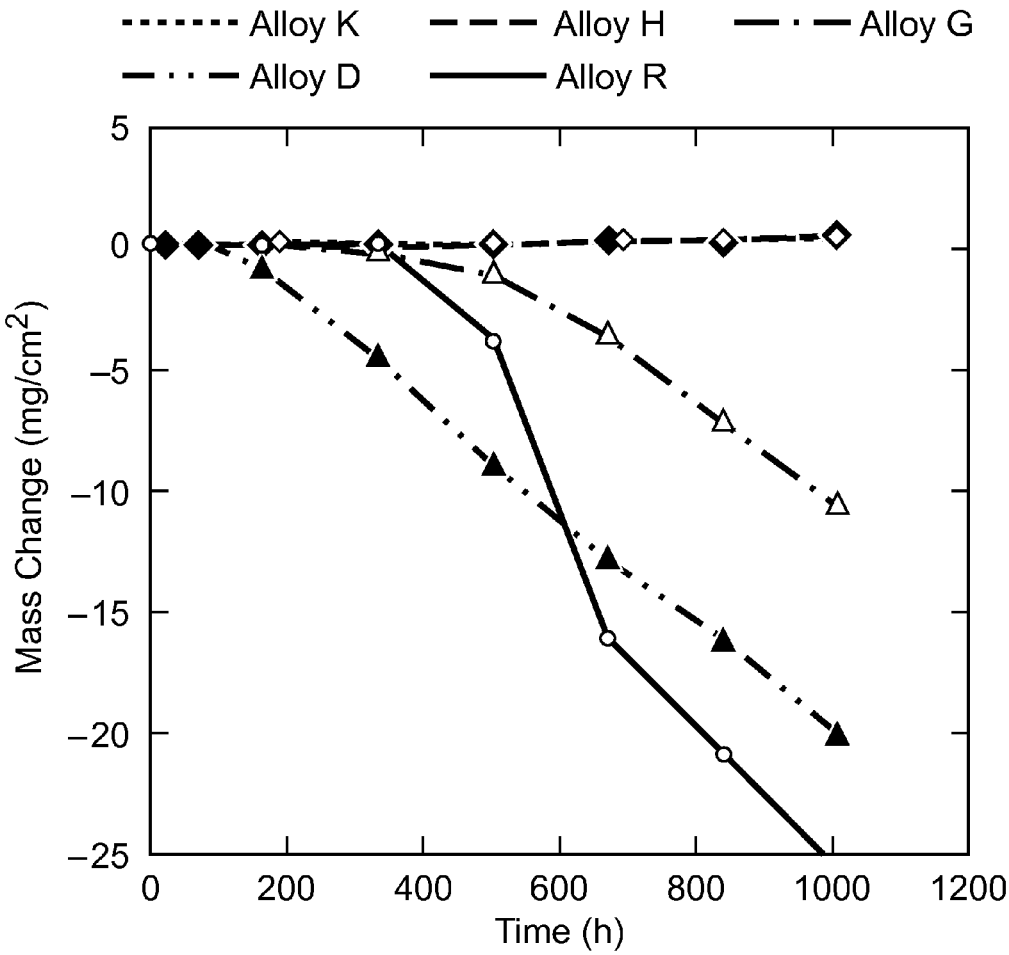
FIG. 1 is a graph showing specific mass changes from oxidation of the high-Mn steel alloys studied exposed at 750° C. in air.

For a better understanding of the present invention, together with other and further objects, advantages and capabilities thereof, reference is made to the following disclosure and appended claims in connection with the above-described drawings.

DETAILED DESCRIPTION OF THE INVENTION

Manganese is currently approximately 18 times less expensive than nickel. In addition, it is effective for stabilizing the austenite structure of iron alloy, particularly when used in combination with nitrogen. Consequently, manganese is a candidate for reducing or replacing nickel as an austenite stabilizing element in stainless steels. The terms, austenite and austenitic, refer to those iron alloys possessing the face-centered-cubic (FCC) crystal structure, which is needed to obtain good high-temperature creep resistance.

Replacement of nickel by manganese in austenitic stainless steels has already been explored for compositions that have desirable properties at either room temperature or cryogenic temperatures. However, such compositions are not suitable for high temperature applications. The oxides of Mn are more thermodynamically stable than those of Cr ($Cr_2O_3$ is used to protect conventional stainless steels from oxidation), grow at unacceptably high rates, and can interfere with protective $Cr_2O_3$ formation if added to the alloy at too high a level. In the present invention, manganese austenitic stainless steel compositions are prepared specifically for high temperature applications, in part by employing a protective $Al_2O_3$ scale, providing a low-cost alloy capable of performing as well or better than existing austenitic and high-nickel stainless steels in high temperature applications, especially those associated with power generation systems components such as boiler tubing and piping, pressure vessels, chemical reactor vessels, tubing, heat exchangers, turbine casings, turbine rotors, and the like.

The present invention involves high-Mn, low-Ni containing austenitic stainless steels that achieve a unique combination of alumina scale formation and high creep strength at elevated temperatures (650-800° C.). Therefore, it is desirable to utilize more Mn and less Ni in order to reduce cost of the material.

New, high manganese alloy (HMA) compositions in accordance with the present invention were made using standard alloy casting methods. Table 1 describes some HMA compositions made as examples of the present invention.

The alloys of the present invention avoid formation of the body-centered-cubic (BCC) phase of iron, as the BCC phase exhibits poor high-temperature strength and degrades creep resistance. This condition is satisfied by adding specified amounts of austenitic stabilizing elements such as Mn, Ni, C, and Cu, together with relatively low amounts of ferritic stabilizing elements such as Cr, Al, Si, and Nb. The terms, ferrite and ferritic, refer to those iron alloys possessing the BCC crystal structure. Although the substitution of Mn for Ni could help to stabilize the FCC structure relative to BCC, more than 15 weight percent Mn (all compositions reported in weight percent, wt. %) was not found to be beneficial for further stabilizing the FCC matrix. In addition, Cr and Al must be added to the alloys to achieve oxidation resistance, based on the results of oxidation testing for alumina scale formation (described in the next section), so that at least 8 weight percent Ni is needed to maintain a single-phase FCC matrix.

Moreover, the alloys of the present invention form alumina scale at 650-800° C. in air or air+water vapor conditions, a condition satisfied by specified amounts of Cr and Al.

Moreover, the alloys of the present invention increase creep resistance and other properties. Introduction of second phase precipitates as a strengthening phase in the alloy is achieved by combined additions of Nb and/or Ta, and C. Further improvement of creep ductility is achieved by addition of B.

EXAMPLES

Samples of compositions were made, labeled D, G, H, and K, and tested for creep and oxidation behavior. A sample of type 347 steel was also tested for comparison. Table 1 describes the compositions nominal compositions of the alloys studied, together with remarks obtained experimentally. Creep resistance is defined as "poor" if the sample exhibited less than 100 h lifetime at 750° C. and 100 MPa in air, "moderate" if between 100-200 h rupture life under this condition, and "good" if greater than 200 h. For oxidation "good" refers to protective alumina scale formation and "no alumina scale" refers to formation of a faster growing, less protective Fe—Cr rich oxide with internal oxidation of Al. Moderate refers to the transition point between these two scale types. These assessments are based on collective results of oxidation in air up to 800° C. and in air with 10% water vapor at 650 and 800° C., for time periods of several hundred to several thousand hours.

Figure 2:
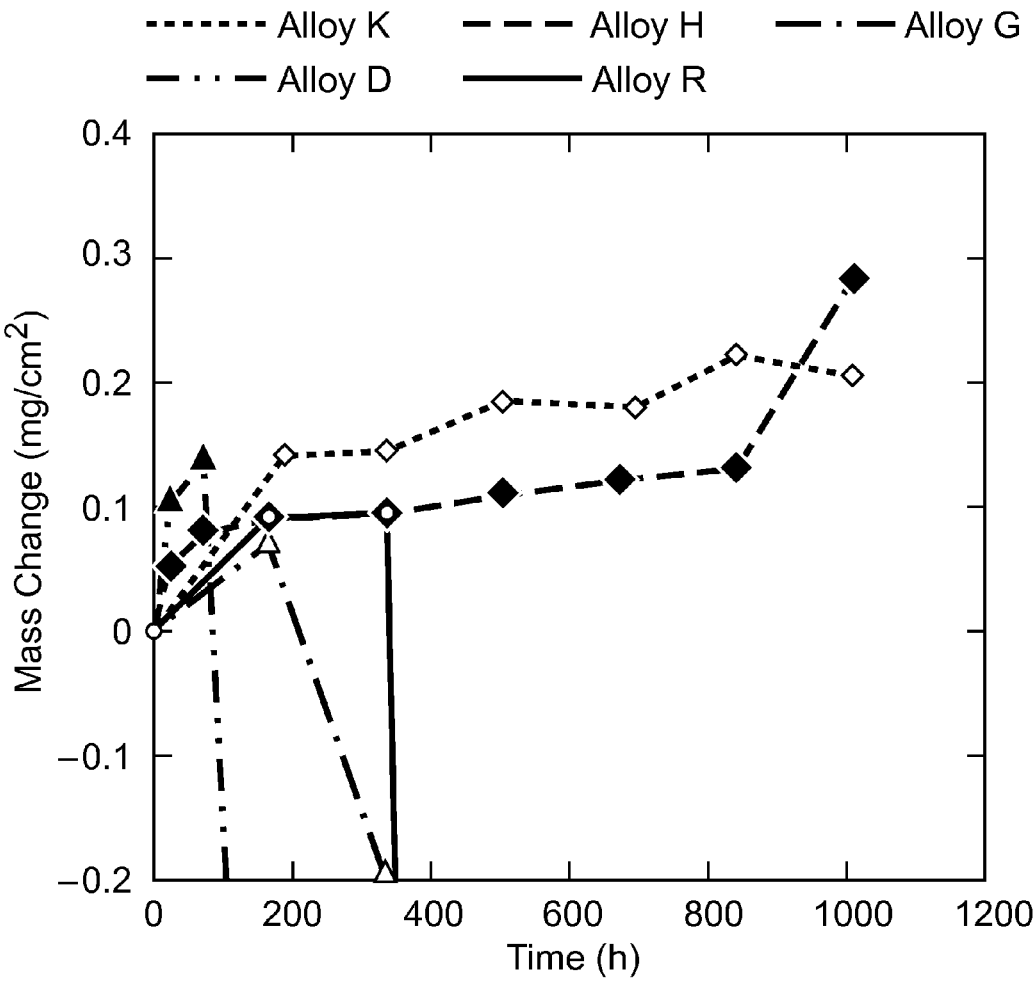
FIG. 2 is a graph showing a magnification of a portion of FIG. 1.

FIGS. 1, 2 show mass changes of example alloys D, G, H, and K exposed at 750° C. in air plotted as a function of time. The results showed the alloys with 14Cr-2.5Al have good oxidation resistance under this condition, even with 15Mn (alloy K), because of the formation of an alumina scale. Alloy K was also exposed for 500 h at 800° C. in air+water vapor, and was able to form alumina under these highly aggressive conditions, although longer term exposure under these conditions resulted in oxide scale spallation and a loss of oxidation resistance. The upper temperature limit for the developed alloys is estimated to be 700-800° C. in air and 650-700° C. in air with water vapor. Conversely, the alloys with 12Cr-3 Al exhibited poor oxidation resistance because of the inability to establish an external alumina scale on the surface; Fe, Cr-rich oxides were formed instead and spalled off during cooling. It should be noted that the alloys with 14Cr-3Al also showed a good oxidation resistance, but exhibited poor creep resistance due to formation of BCC second phase because of the strong BCC stabilizing effect of Al (alloy Q in Table 1).

Figure 3:
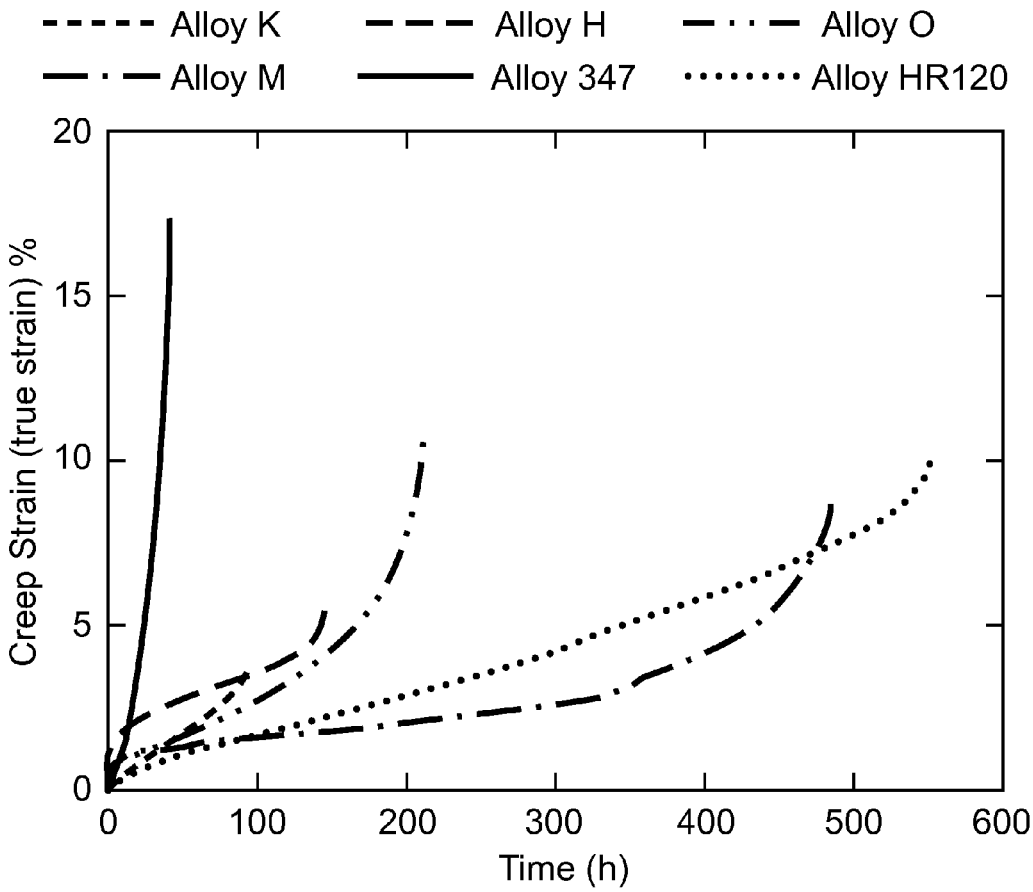
FIG. 3 is a graph showing creep-rupture curves of some of the example alloys tested at 750° C. and 100 MPa in air, together with those of type 347 (18Cr-2Mn-10Ni) and HR120 (25Cr-32Ni) foil.

FIG. 3 shows creep-rupture curves of some of the example alloys with 14Cr-2.5Al tested at 750° C. and 100 MPa in air, together with those of type 347 (18Cr-2Mn-10Ni) and HR120 (25Cr-32Ni) foil. The alloys H and K showed relatively longer creep-lives than type 347, although their creep resistances are still moderate. However, the B additions to the alloys greatly improved the creep properties.

The alloy M (alloy H+0.01 wt % B) showed three times longer life and almost two times greater elongation than those of the alloy without B addition, and the properties are comparable to HR120 alloy foil which contains 32 wt % Ni. The alloy O also showed significant improvement of the properties by addition of B, indicating that the B addition is required for the proposed alloys.

Nominal Mn content of alloys in accordance with the present invention can be in the range of >4% up to 15%, including 4.5%, 5%, 6%, 7%, 8%, 9%, 10%, 11%, 12%, 13%, 14%, and 15%. Nominal Cr content of alloys in accordance with the present invention can be in the range of 14% up to 16%, including 14%, 14.5%, 15%, 15.5%, and 16%. Nominal Al content of alloys in accordance with the present invention can be in the range of 2.4% up to 3%, including 2.4%, 2.5%, 2.6%, 2.7%, 2.8%, 2.9%, and 3%.

While there has been shown and described what are at present considered the preferred embodiments of the invention, it will be obvious to those skilled in the art that various changes and modifications can be prepared therein without departing from the scope of the inventions defined by the appended claims.

Table 1 follows:

TABLE 1

| | | Composition (wt %) | | | | | | | | | | Results | | |
|---|---|---|---|---|---|---|---|---|---|---|---|---|---|---|
| Series | Name | Fe | Cr | Al | Mn | Ni | Cu | Si | Nb | C | B | BCC at 1200 C. (vol. %) | Oxidation Resistance | Creep Strength |
| 10Cr—2.5Al | A | 70.0 | 10 | 2.5 | 10 | 4 | 3 | 0 | 0.4 | 0.15 | 0 | 0 | no alumina scale | n.a. |
| | B | 65.0 | 10 | 2.5 | 15 | 4 | 3 | 0 | 0.4 | 0.15 | 0 | 0 | no alumina scale | poor |
| 12Cr—2.5Al | C | 67.8 | 12 | 2.5 | 5 | 12 | 0 | 0 | 0.6 | 0.1 | 0 | 0 | no alumina scale | poor |
| 12Cr—3Al | D | 65.3 | 12 | 3 | 7 | 12 | | 0 | 0.6 | 0.1 | 0 | 0 | no alumina scale | moderate |
| | E | 60.5 | 12 | 3 | 15 | 6 | 3 | 0 | 0.5 | 0.05 | 0 | 50 | good | n.a. |
| | F | 58.5 | 12 | 3 | 15 | 8 | 3 | 0 | 0.5 | 0.05 | 0 | 18 | moderate | poor |
| | G | 56.5 | 12 | 3 | 15 | 10 | 3 | 0 | 0.5 | 0.05 | 0 | 2 | no alumina scale | poor |
| 14Cr—2.5Al | H | 62.8 | 14 | 2.5 | 5 | 12 | 3 | 0 | 0.6 | 0.1 | 0 | 0 | good | moderate |
| | I | 57.8 | 14 | 2.5 | 10 | 12 | 3 | 0 | 0.6 | 0.1 | 0 | 0 | good | moderate |
| | J | 59.0 | 14 | 2.5 | 15 | 6 | 3 | 0 | 0.38 | 0.15 | 0 | 16 | n.a. | n.a. |
| | K | 57.0 | 14 | 2.5 | 15 | 8 | 3 | 0 | 0.38 | 0.15 | 0 | 2 | good | moderate |
| | L | 55.0 | 14 | 2.5 | 15 | 10 | 3 | 0 | 0.4 | 0.15 | 0 | 0 | good | moderate |
| 14Cr—2.5Al + B | M | 62.8 | 14 | 2.5 | 5 | 12 | 3 | 0 | 0.6 | 0.1 | 0.01 | 0 | (similar to alloy H) | good |
| | N | 59.8 | 14 | 2.5 | 10 | 10 | 3 | 0 | 0.6 | 0.1 | 0.01 | 0 | (similar to alloy I) | n.a. |
| | O | 57.0 | 14 | 2.5 | 15 | 8 | 3 | 0 | 0.4 | 0.15 | 0.01 | 2 | (similar to alloy K) | good |
| 14Cr—3Al | P | 55.6 | 14 | 3 | 15 | 8 | 3 | 0.7 | 0.6 | 0.1 | 0.01 | 53 | n.a. | n.a. |
| | Q | 54.5 | 14 | 3 | 15 | 10 | 3 | 0 | 0.5 | 0.05 | 0 | 25 | good | poor |
| 14Cr—0Al | R | 72.6 | 14 | 0 | 2 | 10 | 0 | 0.7 | 0.6 | 0.1 | 0 | 0 | No alumina scale | poor |

What is claimed is:

1. An austenitic stainless steel alloy consisting essentially of, in terms of weight percent ranges:

4 to 15 Mn;

8 to 15 Ni;

14 to 16 Cr;

2.4 to 3 Al;

0.4 to 1 total of at least one element selected from the group consisting of Nb and Ta;

0.05 to 0.2 C;

0.01 to 0.02 B;

no more than 0.3 of combined Ti+V;

up to 3 Mo;

up to 3 Co;

up to 1 W;

up to 3 Cu;

up to 1 Si;

up to 0.05 P;

up to 1 total of at least one element selected from the group consisting of Y, La, Ce, Hf, and Zr;

less than 0.05 N; and base Fe, wherein the weight percent Fe is greater than the weight percent Ni, and wherein said alloy forms an external continuous scale comprising alumina, nanometer scale sized particles distributed throughout the microstructure, said particles comprising at least one composition selected from the group consisting of NbC and TaC, and a stable essentially single phase FCC austenitic matrix microstructure, said austenitic matrix being essentially delta-ferrite-free and essentially BCC-phase-free.

2. An austenitic stainless steel HTUPS alloy in accordance with claim 1 wherein the Mn weight percent range is 5-14.

3. An austenitic stainless steel HTUPS alloy in accordance with claim 2 wherein the Mn weight percent range is 6-14.

4. The austenitic stainless steel alloy of claim 1, wherein said austenitic stainless steel alloy comprises 0 vol-% BCC-phase.

5. The austenitic stainless steel HTUPS alloy in accordance with claim 4 wherein the Mn weight percent range is 5-14.

* * * * *